United States Patent [19]

Stimson et al.

[11] 4,112,330

[45] Sep. 5, 1978

[54] METALLIZED GLASS SEAL RESISTOR COMPOSITIONS AND RESISTOR SPARK PLUGS

[75] Inventors: Grant L. Stimson; Patrick N. Kesten, both of Davison, Mich.

[73] Assignee: General Motors Corporation, Detroit, Mich.

[21] Appl. No.: 798,858

[22] Filed: May 20, 1977

[51] Int. Cl.[2] ..... H01J 7/44; H01J 13/46; H01J 17/34; H01J 19/78

[52] U.S. Cl. ..... 315/46; 313/118

[58] Field of Search ..... 313/118, 119; 315/46; 252/500

[56] References Cited

U.S. PATENT DOCUMENTS

| | | | |
|---|---|---|---|
| 3,538,021 | 11/1970 | Achey | 313/145 X |
| 3,577,355 | 5/1971 | Blum | 313/145 X |

*Primary Examiner*—Alfred E. Smith
*Assistant Examiner*—Robert E. Wise
*Attorney, Agent, or Firm*—Sidney Carter

[57] ABSTRACT

An electrically stable, radio frequency interference suppressing glass-type resistor seal composition forming a gas-tight seal within the center bore of a ceramic insulator wherein the glass is formed from a mixture, in % by weight, of about 25–50% borosilicate glass and about 50–75% barium borate glass and wherein the metal powder used in the composition consists essentially of a mixture, in parts by weight, of about 1–4 parts antimony and about 2–8 parts silicon. The end portion of the terminal screw positioned within the glass seal may be unroughened for a length of from about 0.065 to about 0.10 inch from the end to preclude breaking of conductivity at the interface of the glass seal with the end portion of the terminal screw.

7 Claims, 2 Drawing Figures

METALLIZED GLASS SEAL RESISTOR COMPOSITIONS AND RESISTOR SPARK PLUGS

Figure 1:
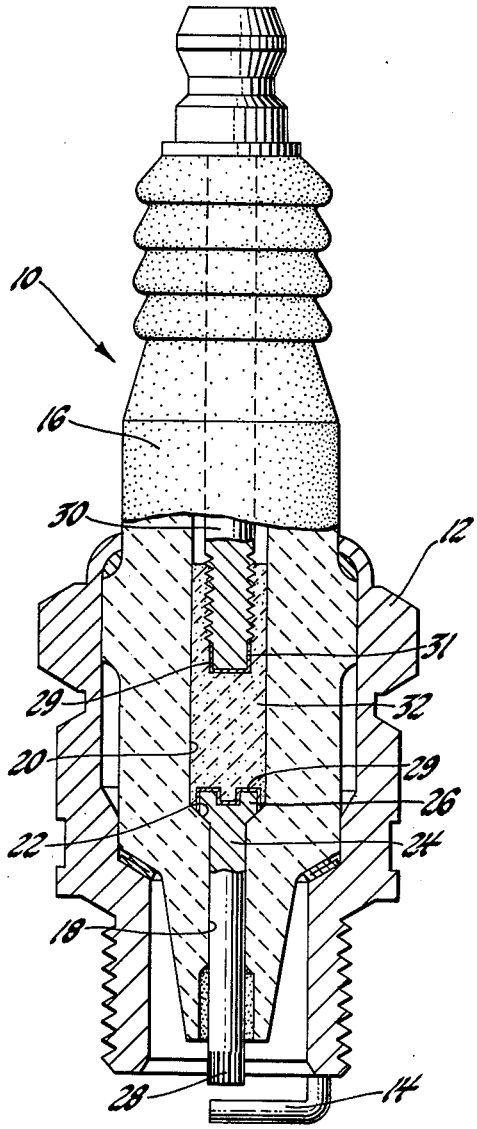

This invention relates to glass-type resistor seal compositions having a high level of electrical resistance stability under conditions of high and low temperature variations and under prolonged use, more particularly to resistor seal compositions used in resistor spark plugs and to such spark plugs.

The use of resistor seal compositions for the suppression of high frequency oscillations which occur in an ignition system due to spark discharge is well known in the art. It is also well known in the art that by proper formulation of the resistor seal composition, the resistance value may be relatively stabilized without the need for preconditioning plug operation. Resistor seals of this type are disclosed in U.S. Pat. No. 3,538,021 to Achey, dated Nov. 3, 1970 and U.S. Pat. No. 3,567,658 to Webb et al, dated Mar. 21, 1971, respectively disclosing resistor compositions and spark plug constructions involving three-load and two-load resistor seals. Each of these patents is assigned to the assignee of the instant invention and each is incorporated herein by reference. Similarly, the U.S. patent to Yoshida et al., U.S. Pat. No. 4,006,106, dated Feb. 1, 1977, discloses a related resistor seal composition involving a one-load seal construction.

While the assignee's prior devices achieve a level of electrical resistance stability which has been satisfactory, the continuing ever more stringent regulations covering the limitation of emissions from automotive engines makes it important to avoid any conditions which would create a spark plug ignition failure since this would cause increased emissions. It is therefore necessary to use such resistor seal compositions in spark plugs as minimize the chance of increasing resistance with temperature variations and with aging or continued use of the resistor spark plug. Also, for reasons of increasingly more stringent controls on radio frequency interference, resistor compositions and spark plugs having greater RFI suppression capability are also required.

In accordance with our invention, both greater RFI suppression and greater thermal and aging stability have been achieved by use of a resistor seal composition in which the glass is formed from a mixture, in % by weight, of about 25–50% borosilicate glass and about 50–75% barium borate glass and wherein the metal powder used in the composition consists essentially of a mixture, in parts by weight, of about 1–4 parts antimony and about 2–8 parts silicon. The end portion of the terminal screw positioned within the glass seal may be unroughened for a length of about 0.065 to about 0.10 inch from the end to preclude cracking of the glass seal at the interface with the end portion of the terminal screw.

It is, accordingly, an object of our invention to provide a resistor seal composition which results in both improved RFI suppression and improved thermal and aging electrical stability.

It is a further object of our invention to provide a spark plug construction which is adapted to substantially improve the RFI suppression and the electrical resistance stability.

Figure 2:
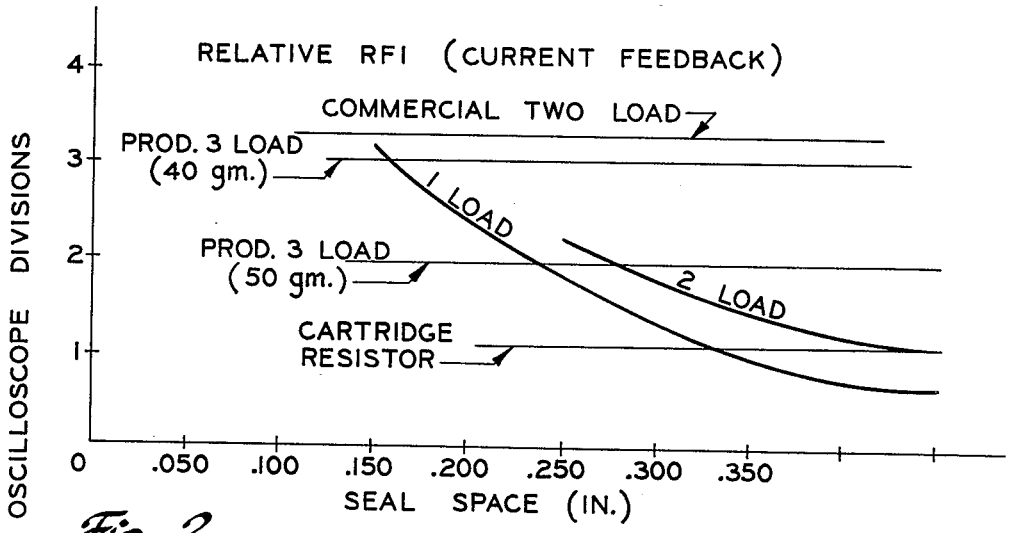

These and other objects of our invention are disclosed in the description which follows and in the drawings in which:

FIG. 1 shows a spark plug partially broken away to show the construction in accordance with our invention, and FIG. 2 shows a plot of RFI suppression capability of various commercially available resistor spark plugs and the spark plugs of our invention.

Referring to FIG. 1, the spark plug 10 comprises a conventional outer metal shell 12 having a ground electrode 14 welded to the lower end thereof. Positioned within the metal shell 12 and secured in the conventional manner is the insulator 16. The ceramic insulator 16 may be of a high alumina base material such as covered by U.S. Pat. No. 2,760,875, issued to Karl Schwartzwalder and Helen Blair Barlett. The insulator 16 is formed with a center bore having a lower portion 18 of relatively small diameter and an upper portion 20 of larger diameter which are connected by the insulator center bore ledge 22. Positioned in the lower portion 18 of the insulator center bore is the conventional nickel center electrode 24. The center electrode 24 is preferably nickel although other metals which can be coated with antimony and silicon may be used. The center electrode 24 has an enlarged head 26 at the upper end thereof which rests on the inner insulator center bore ledge 22 and a lower end 28 thereof projecting beyond the lower tip of the insulator 16. Positioned in the upper portion 20 of the insulator center bore is a terminal screw 30. The resistor element or seal 32 of this invention, which will be hereinafter fully described, is positioned in the insulator center bore 20 and is bonded to the center electrode head 26, to the terminal screw 30 and to the inner walls of the ceramic insulator. The center bore ends of the center electrode 26 and the terminal screw 30 have a metal coating 29 thereon which will be hereinafter also fully described. The end of the terminal screw 30 is formed with an unroughened surface 31 for purposes described fully hereinafter.

In accordance with our invention, the resistor seal composition, as more fully described in U.S. Pat. No. 3,567,658, is a dense, fused mass having high strength and relatively low porosity and containing glass, inert filler material, semiconductor material, carbon, inorganic binder, a water soluble charable carbonaceous material, a flux compound taken from the group consisting of lithium carbonate, zinc carbonate, sodium carbonate and magnesium carbonate, and the metals antimony and silicon. As used in our compositions, the semiconductor material is relied on as a thermal stabilizing material for maintaining the desired resistance level over the life of the resistor. The composition of the resistor seal of our invention may be formed of the following constituents in about the parts by weight noted:

| | Parts by Weight |
|---|---|
| Glass | 18–50 |
| Inert filler - kyanite, borolon, mullite chromium oxide, and the like | 10–45 |
| Semiconductor material - zirconia, titania, and the like | 25–60 |
| Carbon black | 0.1–6.0 |
| Inorganic binder - sodium silicate and clays such as bentonite | 0–3 |
| Water soluble charable carbon containing material - dextrin, sucrose, methyl cellulose, corn flour, polyvinyl alcohol, glycerin | 0.1–4.0 |
| Flux - lithium carbonate, zinc carbonate, sodium carbonate, magnesium carbonate | 0.1–5 |
| Antimony (silicon) | 1–4 (2–8) |

The glass in the resistor seal composition of our invention is formed of a glass mixture consisting essentially of about 25–50 wt. % borosilicate glass and about 50–75 wt. % barium borate glass. We have found that this mixture results in the best balance between (1) stiffness of the seal composition at high temperatures to preclude back-up of the terminal screw at operating temperatures and the occasional high temperature excursions which might be encountered, this improvement in back-up being attributable to the borosilicate glass, and (2) resistance to aging, use over the life of the composition, which tends to increase the resistance of the resistor seal, rapid aging being an undesirable property of borosilicate glass. Also, we have found that the addition of borosilicate glass frit to barium borate glass improves heat shock properties of the composition. The preferred glass mixture is about 25% borosilicate glass and about 75% barium borate glass. We have found that the use of as little as 14 parts by weight glass produces seals which tend to leak due to poor adhesion of the seal composition to the insulator wall. Similarly, the use of too much glass results in a seal having greater electrical resistance and excessive back-up of the terminal screw. As shown in Table I, back-up temperatures of 1700° F. are achieved using the preferred glass mixture in resistor seals of our invention, as compared to temperatures of 1600° F. and 1200° F. for resistor seals of commercial spark plugs of the three-load and two-load type. The data in the parenthesis is the back-up in inches.

The use of a semiconductor material such as zirconia, titania, and the like, is called for in the amount of from about 25 to 60 parts by weight since we have found that substantially larger amounts produce a composition which is too stiff for hot-pressing a gas-tight seal where the seal length is greater than about 0.30 inch, too low an amount, resulting in electrical aging and resistance change. Similarly, excess flux causes embrittlement of the glass seal with resultant leakage.

The barium borate glass which is preferred is a composition containing 75 weight percent $B_2O_3$ and 25% BaO. Another barium borate glass is a composition containing 60 weight percent $B_2O_3$, 32 weight percent BaO, 6 weight percent $Na_2O$ and 2 weight percent CaO. Another example is a composition containing 60 weight percent $B_2O_3$, 38 weight percent BaO and 2 weight percent $Na_2O$. As noted above, the total amount of the particulate glass used has no appreciable effect on the resistance of the composition within the limits of about 18 to 50 parts by weight. The fusion temperature of the preferred barium borate glass is about 1350° F.

The borosilicate glass which is preferred is a composition containing, in wt. %, $SiO_2$ — 65%, $B_2O_3$ — 23%, $Al_2O_3$ — 5%, PbO — 0.5%. Note that this composition has a relatively low amount of lead and is therefore of the high melting point type. The fusion or softening temperature for this glass is about 1550° F. Other such glass compositions well known in the art may be used provided the softening temperature is sufficiently high as indicated to assure the proper stiffness of the seal composition at elevated temperatures.

As indicated above, we have found that it is highly desirable to provide a glass seal resistor composition which has a stable electrical resistance, that is, a resistance which does not change in value with use (aging) and with exposure to high temperatures and thermal shock, by more than 15% from the designed value. To achieve this goal, in addition to the mixture of glass described, we have found that the metal added to the glass seal composition of our invention as defined herein, hereinafter referred to as a "metallized glass seal resistor" or a "metallized glass seal resistor composition", is required to also be a mixture of metals, specifically, antimony and silicon. As described in U.S. Pat. No. 3,567,658, the antimony melts during the hot-pressing operation, carried out at about 1650°–1725° F. in manufacture of the spark plug, and forms a coating on the ends of nickel centerwire and the nickel plated terminal screw, the contact members.

While this antimony coating insulates these contact members from oxidation, we have found that the antimony is itself susceptible to oxidation with the result that the resistance value change with aging and exposure to elevated temperatures exceeds the 15% limit. The continued formation of a metal oxide coating can result in the breaking of electrical contact. We have found that the oxidation of antimony is substantially resisted by the addition of small amounts of silicon to the resistor seal composition. We have also found that the addition of metals such as copper, zinc and nickel in lieu of silicon does not inhibit the oxidation of the antimony. During hot-pressing of the seal composition, both the antimony and the silicon coat the ends of the contact members.

Chart I shows the effect of various metal blends on heat shock and relative RFI when using the metallized glass seal resistor composition in accordance with our invention. The length of the seal between the ends of the terminal screw and the centerwire is at least 0.30 inch and the preferred length or seal space is about 0.350 inch in order to obtain acceptable RFI suppression. Heat shock as used herein is the percentage resistance change based on the value at ambient temperature when measuring the resistance of the insulator assembly before and after the parts are heated to 1000° F. and there held for 15 minutes followed by cooling to ambient temperature. Relative RFI as used herein is the current feedback in the spark plug while firing, as measured by the peak amplitude shown on an oscilloscope which is clipped to the top of the terminal screw, the peak amplitude being a convenient measure of the RFI of the spark plug.

CHART I

| | Parts by Weight | | | |
|---|---|---|---|---|
| | Sb | Si | Heat Shock | RFI |
| a. | 1 | 1 | +7% | - |
| b. | 1 | 2 | 0% | 1.6 |
| c. | 2 | 3 | +3% | 1.2 |
| d. | 2 | 4 | −0.2% | 0.90 |
| e. | 3 | 6 | −0.4% | 0.93 |
| f. | 4 | 8 | +1.1% | 1.6 |

As shown, the data for blends of from about 4–6 parts silicon and from about 2–3 parts antimony indicate a close and optimum performance. However, we prefer the blend of about 2 parts antimony — 3 parts silicon since it results in sufficient metal available for coating the contact members while being well within acceptable heat shock and RFI limits. The RFI for blend a. was not measured in view of the high heat shock value. Blend b. was not chosen as the preferred mix in view of there not being sufficient metal for use with an 0.350 inch seal space. This blend would be preferred with a seal space less than about 0.30 inch.

Accordingly, the preferred metallized glass seal resistor composition of our invention contains the following constituents in the amounts shown:

| | Grams | Wt. % |
|---|---|---|
| Barium borate glass | 20 | 17.8 |
| Borosilicate glass | 9 | 8.0 |
| Zirconia | 44 | 39.3 |
| Mullite | 28 | 25.0 |
| Bentonite | 1.8 | 1.6 |
| Carbon Black (Thermax) | 2.75 | 2.4 |
| Water soluble carbonaceous material (Sugar-10x) | 0.47 | 0.4 |
| Lithium carbonate | 1.0 | 0.9 |
| Antimony | 2 | 1.8 |
| Silicon | 3 | 2.7 |

The test data shown in Table I is based on the use of applicants' preferred metallic glass seal resistor composition disclosed above and shows the significantly better results achieved by applicants as compared to current production by applicants' assignee and competitor's commercial resistor spark plug designs. The aging test data represent the percentage change in resistance based on initial resistance, when applying 10,000 volts at 2 amps to the spark plugs three successive cycles for one minute each, the resistance being measured both before and after the test. This is an accelerated test which indicates the probability of excessive change in resistance on aging if the measured change is greater than 15%.

TABLE I

| Spark Plug Design and Seal Space | Powder Weights | KΩ Resistance | RFI | 1000° F. Heat Shock | Back-up Temperature | 10KV Aging |
|---|---|---|---|---|---|---|
| One-Load | | | | | | |
| .150" | .40 gm. | 4.38 | 3.18 Div | −8.6% | 1700° F(.005") | −33% |
| .250" | .55 | 7.27 | 1.85 | −2.1 | 1700° F(.005") | −18 |
| .350" | .70 | 11.94 | 1.00 | −3.1 | 1700° F(.005") | − 8 |
| .450" | .85 | 14.92 | 0.70 | +0.3 | 1700° F(.010") | − 9 |
| Two-Load | | | | | | |
| .250" | .40R*+.15C* | 5.94 | 2.20 | −6.6 | 1700° E(.010") | −46 |
| .350" | .55R+.15C | 10.97 | 1.52 | −5.8 | 1700° E(.015-) | −13 |
| .450" | .70R+.15C | 11.60 | 1.10 | −4.6 | 1700° F.(.015") | −11 |
| Current Production Three-Load | .13C* | — | — | — | — | — |
| | .40R** | 4.71 | 3.08 | +0.4 | 1600° F(.015") | +12 |
| | .50R** | 6.50 | 2.00 | +0.6 | 1600° F(.010") | + 9 |
| | .18C* | — | — | — | — | — |
| Commercial-Cartridge Resistor | | 11.00 | 1.1 | −1.1 | Terminal Screwed In | +1.8 |
| Commercial-Two-Load Glass seal | | 3.90 | 3.30 | +42.0 | 1200° F(.020") | ∞ |

*The weight of applicants' metallized glass seal resistor composition is indicated by "R".
*The weight of applicants' conductor seal composition is indicated by "C".
**The weight of resistor seal material disclosed used in assignee's patent 3,538,021.

FIG. 2 shows the relative RFI output for the metallized glass seal resistor compositions of our invention and plug designs using such compositions, as compared with current production three-load resistor spark plugs of the assignee of our invention and with competitive commercial resistor spark plugs. Only the one-load and two-load plugs of our invention were measured at varying seal space, the commercial plugs being measured without analysis to determine the length of the resistor composition column between the ends of the terminal screw and the center electrode.

The metallized glass seal resistor composition of our invention forms a non-aging resistor, i.e., once the resistance is established during glass sealing the resistance will not change more than about ± 15% during service, this without any need for preconditioning as is practiced in the art. In this regard, carbon is the principal control material for establishing the resistance value in our compositions, both coarse and fine carbon being used. As noted, we use a coarse carbon, Thermax, −35 to +325 mesh, which ages downward in resistance together with a fine carbon, e.g., powdered sugar (10× brand) which ages upward, the ratio being about 5 to 6:1 of coarse to fine carbon for a mixture which balances at substantially no resistance change with aging. Chart 2 shows the effects of varying the carbon on stabilized resistance value as used in compositions of our invention.

CHART 1

| Resistance - nominal | Carbon - Weight % | |
|---|---|---|
| 5000 Ω | Thermax | 1.5 |
| | 10x | 0.3 |
| 10,000 Ω | Thermax | 1.4 |
| | 10x | 0.25 |
| 150 Ω | Thermax | 5.1 |
| | 10x | 0.72 |

In preparing the compositions for the one and two-load resistor spark plug designs, and in assembling the spark plugs, the same processing is used as is described in U.S. Pat. No. 3,567,658 for the two-load plugs. Where a two-load plug is to be made, the same type glass-metal conductor seal as in the patent may be used. Since these operations form no part of our invention, their description is incorporated herein by reference.

We have also discovered that the design of the terminal screw is significant in the design of a spark plug which has a stabilized resistance value through its life cycle. We have found that due to the differences between the rates of thermal expansion of the terminal screw, the high alumina type insulator, the conductor seal if used (two-load plugs), and the metallized glass resistor seal of our invention, which have coefficients of thermal expansion, respectively, of $12 \times 10^{-6}/°$ C., $8.2 \times 10^{-6}/°$ C., $6.3 \times 10^{-6}/°$ C., and $5.6 \times 10^{-6}/°$ C., there is a tendency for the glass seal to crack at its interface with the bottom portion of the terminal screw. As a result of many experiments with different designs, we have discovered that the roughened terminal screw, e.g., one with knurls, threads, etc., should be formed with its bottom portion unroughened or smooth for a length from the bottom surface of from about 0.065 to about 0.10 inch as shown at 31 in FIG. 1. This avoids the breaking of conductivity between the terminal screw end and the seal and thus precludes plug failure. The breaking of conductivity would otherwise result from the differences in thermal expansion coefficients of the glass seal and the terminal screw.

While we have shown and described our invention in the form of a one-load spark plug, it should be understood that it is equally applicable to two-load spark plugs and to plugs of different design such as the surface gap plug, and also to cartridge type resistor elements. Other applications will be apparent to those skilled in the art and are intended to be within the scope of our invention as defined by the claims which follow.

We claim:

1. In a glass-type resistor composition adapted to form a gas tight seal within the centerbore of a ceramic insulator between metal contact members, said composition including a metal powder to control oxidation of said metal contact members, the invention comprising the use of a glass mixture consisting essentially of about 25–50% borosilicate glass and about 50–75% barium borate glass, and the use of a mixture of metal powders consisting essentially of from about, in parts by weight, 1–4 parts antimony and 2–8 parts silicon, to obtain stable electrical resistance in field use, resistance to oxidation of metal contact members and said metal powders, and improved RFI suppression.

2. In a resistance composition as set forth in claim 1, the use of a mixture of metal powders of from about 2–3 parts antimony and from about 3–6 parts silicon and of about 25% borosilicate glass and about 75% barium borate glass.

3. In a resistance composition as set forth in claim 1, the use of about 17.8% barium borate glass, 8.3% borosilicate glass, 39.3% zirconia, 25% mullite, 1.6% bentonite, 2.4% carbon black, 0.4% water soluble charable carbonaceous material, 0.9% flux, 1.8% antimony and 2.7% silicon.

4. In an electrically stable resistor spark plug having a glass-type resistor seal in the centerbore of the insulator in contact with and forming the electrical connection between the ends of the terminal screw and of the centerwire positioned within said centerbore, the improvement comprising the use of a resistor seal composition as set forth in claim 1 for electrical stability and improved RFI suppression.

5. In a spark plug as set forth in claim 4, the improvement comprising the end portion of said terminal screw positioned within said resistor composition being formed with an unroughened surface for about 0.065 to about 0.10 inch of length from said end to avoid breaking of conductivity at the interface of said glass seal with the end portion of said terminal screw.

6. In an electrically stable resistor spark plug having a glass-type resistor seal in the centerbore and bonded to the wall of the centerbore and the inner end of the center electrode and the terminal screw to form a gas tight electrical connection therebetween, the terminal screw having a roughened surface on that portion thereof bonded to said glass-type resistor seal, the improvement comprising said terminal screw being formed with an unroughened surface for about 0.065 to about 0.10 inch of the length from the end thereof to preclude breaking conductivity at the interface of said glass seal with said end, and said resistor composition being as set forth in claim 2.

7. In an electrically stable resistor spark plug having a glass-type resistor seal in the centerbore and bonded to the wall of the centerbore and the inner end of the center electrode and the terminal screw to form a gas tight electrical connection therebetween, the terminal screw having a roughened surface on that portion thereof bonded to said glass-type resistor seal, the improvement comprising said terminal screw being formed with an unroughened surface of about 0.065 to about 0.10 inch of the length from the end thereof to preclude breaking conductivity at the interface of said glass seal with said end, and said resistor composition being as set forth in claim 3 and the seal length between the ends of said terminal screw and said centerwire being at least about 0.30 inch.

* * * * *

UNITED STATES PATENT AND TRADEMARK OFFICE

CERTIFICATE OF CORRECTION

PATENT NO. : 4,112,330

DATED : September 5, 1978

INVENTOR(S) : Grant L. Stimson
Patrick N. Kesten

It is certified that error appears in the above-identified patent and that said Letters Patent are hereby corrected as shown below:

In the patent, col. 5, Table I, in the column entitled "Back-Up Temperature", under the "Two-Load" section, a. opposite the ".250", "1700° E" should read -- 1700° F --;

b. opposite the ".350", "1700° E(.015-)" should read -- 1700° F(.015") --;

under the "Three-Load" section

In the patent, in the footnotes for Table I, in the ** line, delete the word "used".

Signed and Sealed this

*Twenty-second* Day of *May 1979*

[SEAL]

*Attest:*

RUTH C. MASON
*Attesting Officer*

DONALD W. BANNER
*Commissioner of Patents and Tradema*